United States Patent [19]

Plevak et al.

[11] 4,325,659

[45] Apr. 20, 1982

[54] MINERAL MINING INSTALLATION

[75] Inventors: Lubomir Plevak, Lunen-Horstmar; Walter Weirich, Dortmund, both of Fed. Rep. of Germany

[73] Assignee: Gewerkschaft Eisenhutte Westfalia, Lunen, Fed. Rep. of Germany

[21] Appl. No.: 127,768

[22] Filed: Mar. 6, 1980

[30] Foreign Application Priority Data

Mar. 8, 1979 [DE] Fed. Rep. of Germany ..... 2909165

[51] Int. Cl.[3] ..... E21D 23/16

[52] U.S. Cl. ..... 405/299; 405/302

[58] Field of Search ..... 405/291, 299–302; 91/170 MP; 299/31, 33

[56] References Cited

U.S. PATENT DOCUMENTS 2,859,022 11/1958 Frye ..... 405/302
2,910,281 10/1959 Wilkenloh et al. ..... 405/302
3,120,105 2/1964 Kibble et al. ..... 405/302 X
4,158,326 1/1979 Krieger ..... 405/302 X

*Primary Examiner*—David H. Corbin
*Attorney, Agent, or Firm*—Thompson, Birch, Gauthier & Samuels

[57] ABSTRACT

A longwall mineral mining installation has a longwall conveyor and a plurality of roof support units positioned side-by-side at the goaf side of the conveyor. The hydraulic appliances of the roof support units, such as their hydraulic props, hydraulic advance rams and hydraulic control valves, are supplied with pressurized hydraulic fluid from hydraulic supply lines which run along the goaf side of the conveyor. A plurality of flat, plate-like intermediate members are provided at the goaf side of the conveyor. These intermediate members are formed with internal ducts for feeding the hydraulic fluid from the supply lines to the hydraulic appliances of the roof support units.

13 Claims, 4 Drawing Figures

MINERAL MINING INSTALLATION

BACKGROUND TO THE INVENTION

This invention relates to a longwall mineral mining installation having a conveyor and a plurality of roof-support units positioned side-by-side at the goaf side of the conveyor.

The roof support units of such an installation have a number of hydraulic appliances which require feeding with pressurised hydraulic fluid. Thus, apart from their hydraulic props and hydraulic advance rams, roof support units may also have hydraulic control valves, hydraulic alignment devices and hydraulically-controlled gap-sealing devices. It is usual to run the hydraulic supply lines for these hydraulic appliances in channels provided on the goaf side of the conveyor, and to connect the hydraulic appliances to these supply lines by separate flexible hoses. In order to supply the numerous hydraulic appliances of the roof support units, a large number of hoses have to be laid, and these are very difficult to accommodate in the already congested region between the conveyor and the roof support units. In thin seams in particular, these hoses impede movement in an intolerable manner. Moreover, the unprotected hoses are easily damaged.

The object of the invention is to provide a mineral mining installation in which the hydraulic appliances of the roof support units are connected to supply lines running along the goaf side of the conveyor in such a way that there is no need for flexible hoses to cross the region between the conveyor and the roof support units.

SUMMARY OF THE INVENTION

The present invention provides a mineral mining installation comprising a conveyor, a plurality of hydraulically-operated roof support units positioned side-by-side at one side of the conveyor, hydraulic supply lines running along said one side of the conveyor, and a plurality of intermediate members positioned at said one side of the conveyor, the intermediate members being provided with internal ducting for feeding hydraulic fluid from the supply lines to the roof support units.

Advantageously, each intermediate member is provided with a plurality of internal ducts which comprise said internal ducting, and each internal duct is provided with a port at each end thereof, one of said ports being hydraulically connected to one of said hydraulic supply lines by a flexible hose, the other of said ports being hydraulically connected to one of said roof support units by another flexible hydraulic hose. Preferably, each intermediate member is an elongate, flat, plate-like member. In this case, the internal ducts of each intermediate member may be longitudinally-extending bores. It is also preferred to hinge the intermediate members to the conveyor, expediently in such a way that they can be pivoted upwards when negotiating uneven zones in the floor of a mine working.

Thus, according to the invention, the hydraulic appliances of the roof support units are supplied with hydraulic fluid via the internal ducting within the intermediate members. Consequently, there is no need for flexible hoses to cross the region between the conveyor and the roof support units.

The intermediate members may be positioned adjacent to the base of the conveyor, the ports may comprise sockets extending from the upper surfaces of the intermediate members, and the sockets at the two ends of a given internal bore may be mutually outwardly inclined. This assists with the attachment of the hoses.

In a preferred embodiment, each roof support unit is provided with a respective intermediate member. In this case, each roof support unit may be provided with an advance mechanism including a hydraulic advance ram and relay rod means for transferring force from the advance ram to the conveyor, the intermediate member associated with a given roof support unit being positioned between its relay rod means and the conveyor. In this arrangement, therefore, the intermediate members form part of the advance mechanisms of the roof support units.

Advantageously, the relay rod means of each roof support unit is rigidly attached to the associated intermediate member, and each of the intermediate members is pivotally attached to the conveyor. Preferably, the relay rod means of each roof support unit is rigidly attached to a head which forms part of the associated intermediate member. Conveniently, each head projects upwardly beyond the upper surface of its intermediate member, and is provided with wings extending towards the conveyor at the lateral edges of that intermediate member, the sockets of that intermediate member adjacent to the associated roof support unit being positioned between said wings. In this way, the hose connections at these ends are at least partially protected in the pocket-like regions formed by the upstanding heads and wings of the intermediate members.

Preferably, each intermediate member is pivotally attached to the conveyor by means of a respective bifurcated hinge member, the sockets of that intermediate member adjacent to the conveyor being positioned in the region of the bifurcated hinge member. Thus, the hose connections at these ends are also at least partially protected.

In another preferred embodiment, each intermediate member extends between a pair of adjacent roof support units, each internal duct is provided with a first port at that end adjacent to the conveyor and with two second ports at that end thereof which is remote from the conveyor, one second port of each internal duct being provided with a first port at that end adjacent to the conveyor and with two second ports at that end thereof which is remote from the conveyor, one second port of each internal duct serving to feed hydraulic fluid to one of the associated pair of roof support units, and the other second port of each internal duct serving to feed hydraulic fluid to the other of the associated pair of roof support units.

The invention also provides a roof support unit having a roof shield supported on a floor sill by hydraulic props, wherein hydraulic fluid is supplied to the roof support unit via internal ducts formed in an intermediate member associated with the floor sill.

BRIEF DESCRIPTION OF THE DRAWINGS

Two forms of mineral mining installation constructed in accordance with the invention will now be described, by way of example, with reference to the accompanying drawings, in which.

DESCRIPTION OF PREFERRED EMBODIMENTS

Figure 1:
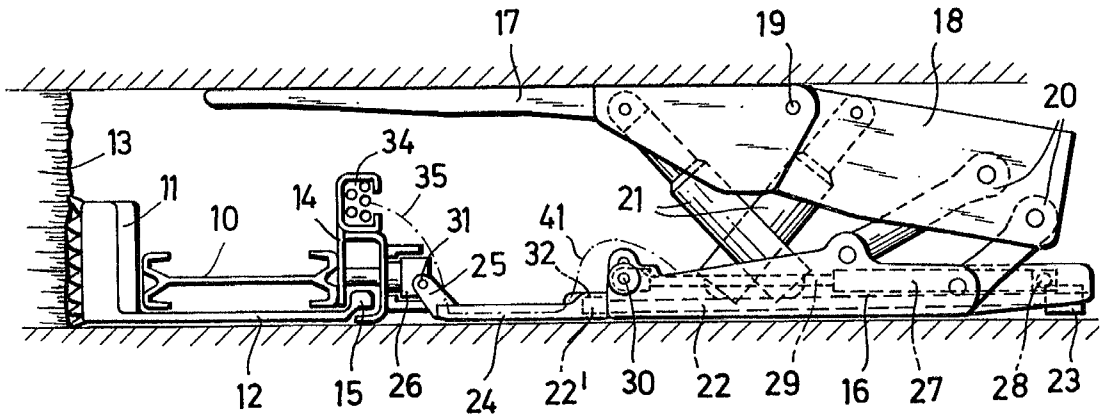
FIG. 1 is a schematic side elevation of the first form of mineral mining installation, and shows a roof support unit, an advanceable conveyor, and an intermediate member.

Referring to the drawings, FIG. 1 shows a longwall conveyor 10, and a plough 11 which is movable to and fro along the conveyor to win coal (or other mineral material) from a longwall face 13. The conveyor 10 is a scraper-chain conveyor. The plough 11 is provided with a sword-plate 12, which passes underneath the conveyor 10. The sword-plate 12 is connected to an endless drive chain (not shown), which is housed within a guide 14 at the goaf side of the conveyor 10. The sword-plate 12 has a guide block 15, which extends into the guide 14 to engage the drive chain.

A plurality of identical roof support units are provided at the goaf side of the conveyor 10. Each of the roof support units has a floor sill 16, a roof shield 17, a goaf shield 18, and hydraulic props 21. The goaf shield 18 of each roof support unit is pivotally connected, at 19, to its roof shield 17, and is joined to its floor sill 16 by means of a lemniscate guide constituted by a pair of links 20. The props 21 of each roof support unit are supported on its floor sill 16 in ball-and-socket joints (not shown), and are pivotally connected to its roof shield 17 and its goaf shield 18. Both the floor sill 16 and the roof shield 17 of each roof support unit may be of one-part or multi-part construction.

Each of the roof support units is connected to the conveyor 10 by means of a respective advance mechanism. The advance mechanism of each roof support unit includes a pair of cylindrical relay rods 22 whose rear (goaf) ends, are inter-connected by means of a slide member 23. The forward ends 22' of the relay rods 22 of each advance mechanism are attached to a plate-like intermediate member 24, which in turn is attached, via a bifurcated hinge member 25, to a support 26 fixed to the goaf side of the conveyor 10. Each advance mechanism also includes a hydraulic advance ram 27 whose cylinder is pivotally attached, by means of a link 28, to the slide member 23. The piston rod 29 of each advance ram 27 is attached, via a link 30, to the forward end of the corresponding floor sill 16. The arrangement is such that, when the advance rams 27 are retracted, the conveyor 10 is advanced towards the face 13 by means of the relay rods 22 and the slide members 23, each slide member being guided in elongate guides extending along the respective floor sill 16. Similarly, when the advance rams 27 are extended, the roof support units are advanced to follow up the advance of the conveyor 10, the conveyor forming an abutment for this advance movement of the roof support units.

Figure 3:
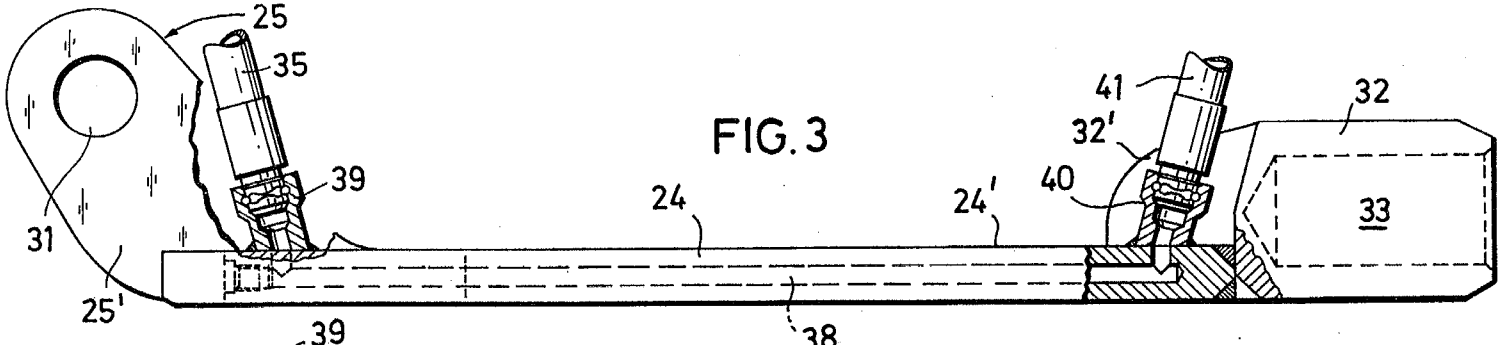
FIG. 3 is a part-sectional side elevation of the intermediate member of FIGS. 1 and 2.
Figure 2:
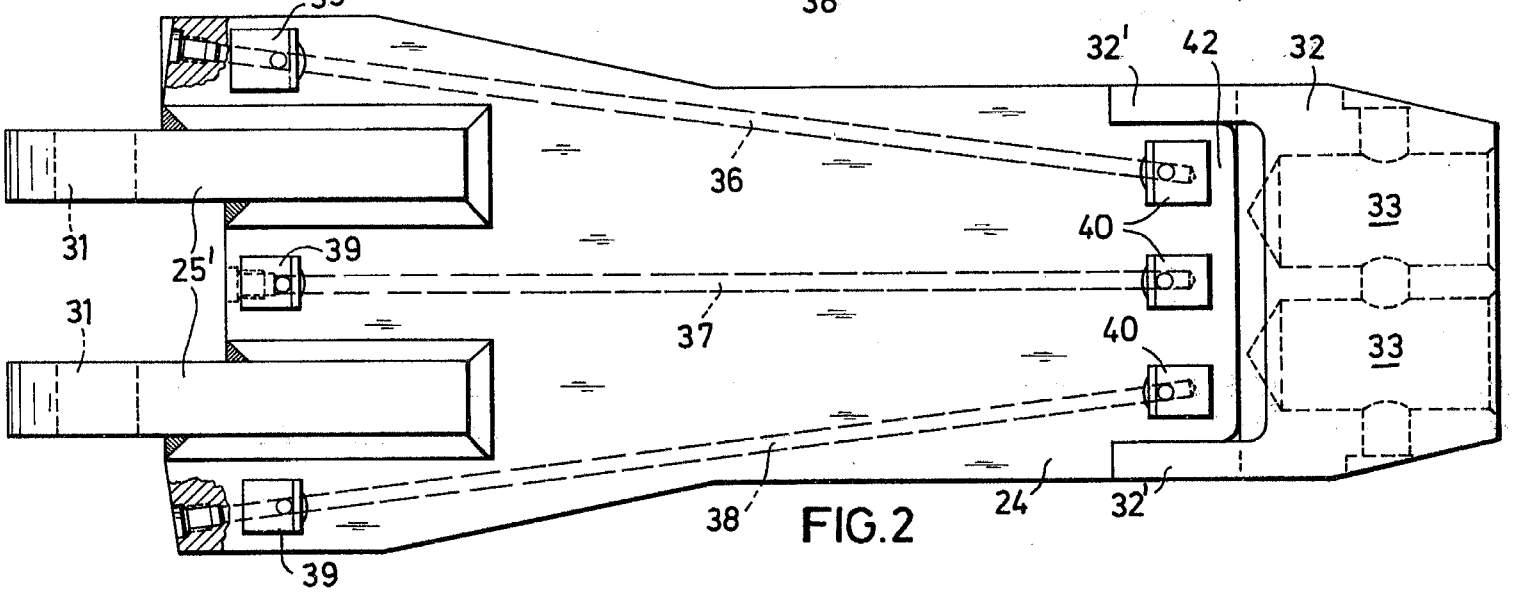
FIG. 2 is a plan view of the intermediate member of FIG. 1.

The force exerted by a given advance ram 27 is transmitted, via the respective intermediate member 24, to the conveyor 10. As shown in FIGS. 2 and 3, the forward end of each intermediate member carries the respective bifurcated hinge member 25, the parallel, upwardly-projecting arms 25' of which have apertures 31 through which a pivot pin (not shown) passes to connect that hinge member to the respective support 26. At its rear end, each intermediate member 24 has a rearwardly-extending head 32 which projects upwardly beyond the upper surface 24' of that intermediate member. Each head 32 is formed with a pair of parallel bores 33 which receive the forward ends 22' of the respective relay rods 22 (see FIG. 1).

In order to supply the props 21, the advance rams 27 and other hydraulic appliances such as alignment rams and gap-sealing devices (not shown) with pressurised hydraulic fluid, hydraulic supply lines (hoses) are laid in a duct 34 at the goaf side of the conveyor 10. The supply lines are connected to the various roof support units by means of short flexible hydraulic hoses 35 (only one of which can be seen—in dash-dot lines—in FIG. 1). Each of the intermediate members 24 is provided with three longitudinal bores 36, 37 and 38, which extend from the bifurcated hinge member 25 to the region immediately adjacent to the head 32. As shown in FIG. 2, the bores 36, 37 and 38 of each intermediate member 24 converge towards the respective head 32, to correspond with the diminishing width of that intermediate member. The longitudinal bores 36, 37 and 38 form internal ducts for the passage of hydraulic fluid, and each has ports 39 and 40 at the ends thereof. Each of the ports 39 receives the end of one of the hoses 35, and each of the ports 40 receives the end of a flexible hydraulic hose 41, the hoses 41 serving to connect the rear ports 40 to the various hydraulic appliances of the roof support units. As shown in FIG. 2, the ports 39 and 40 are inclined away from one another so as to lie in the paths of the hoses 35 and 41 respectively.

One of the internal ducts 36, 37 and 38 of each intermediate member 24 is a high-pressure duct for supplying high-pressure hydraulic fluid to the corresponding roof support unit. Similarly, one of the ducts 36, 37 and 38 establishes contact with the return line of the hydraulic system, and the other duct is used for connecting a control line. Such a control line is used for remote-controlled actuation of valves. Further ducts could be provided within the intermediate members for one or more of these functions. Where the roof support units are equipped with water-spray nozzles for dust suppression, the intermediate members 24 are each formed with a further duct for conveying pressurised water to the nozzles.

The rear ports 40 of each intermediate member 24 lie in a protected position 42 in front of the head 32 of that member, and between a pair of wings 32' which project forwardly from that head. Preferably, the wings 32' are formed integrally with their heads 32. Similarly, the forward ports 39 of each intermediate member lie in a position protected by the arms 25' of the respective bifurcated hinge member 25.

Figure 4:
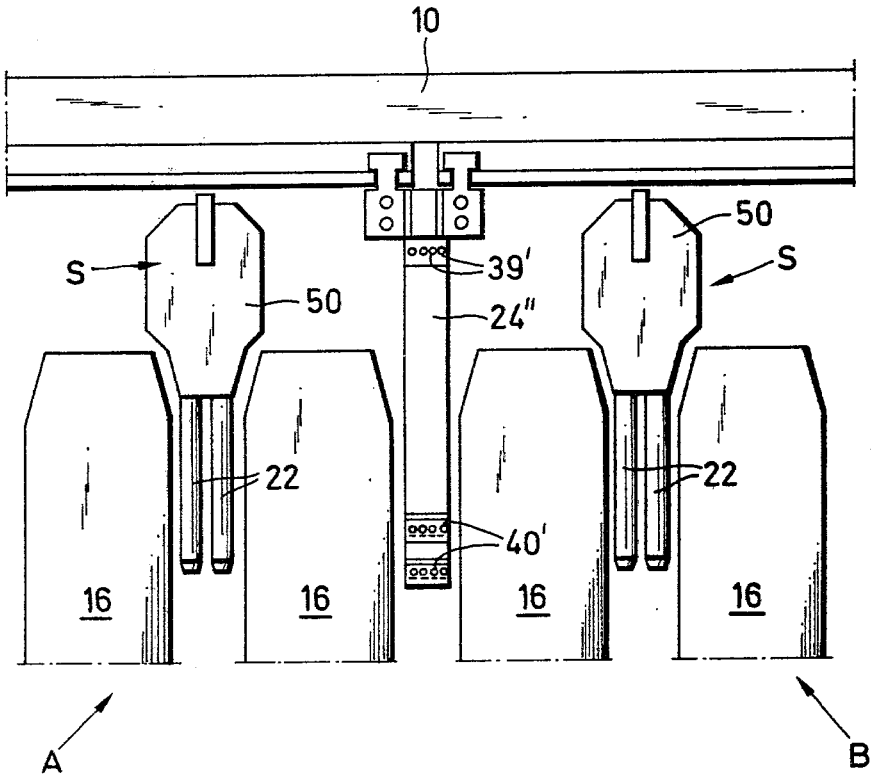
FIG. 4 is a plan view of the second form of mineral mining installation, and shows two roof support units, an advanceable conveyor, and an intermediate member.

FIG. 4 is a diagrammatic illustration of a second form of installation, in which each pair of adjacent roof support units is provided with a single, common intermediate member. Thus, FIG. 4 shows two adjacent roof support units A and B and a longwall conveyor 10. Each of the roof support units A and B is provided with an advance mechanism S for advancing the conveyor 10 and for subsequently advancing that unit in a follow-up sequence. The advance mechanisms S are similar to that described above with reference to the embodiment of FIGS. 1 to 3, and each includes a pair of parallel relay rods 22. However, in this embodiment, the relay rods 22 of each roof support unit are connected to the conveyor 10 through a respective head-piece 50. The head-pieces 50 are similar to the intermediate members 24 of the embodiment of FIGS. 1 to 3 in that they are of plate-like configuration. The head-pieces 50 are also of similar shape to the intermediate members 24 of FIGS. 1 to 3. However, the head-pieces 50 are not provided with internal ducts for hydraulic fluid. These ducts (not shown) are provided in intermediate members (one of which 24'' is shown in FIG. 4). The intermediate member 24'' is positioned between the floor sills of the two roof support units A and B (each of these floor sills being constituted by a pair of floor girders 16). The intermediate member 24'' is a narrow plate-like strip provided with four internal bores (not shown) which correspond to the bores 36, 37 and 38 of the embodiment of FIGS. 1 to 3. The intermediate member 24'' also has ports 39' and 40' adjacent to its two ends, these ports being similar to the ports 39 and 40 of FIGS. 1 to 3. Here, however, there are four ports 39' and two sets of four ports 40'. The sets of ports 40' are connected to the hydraulic appliances of the roof support units A and B respectively. Thus, the intermediate member 24'' serves to transmit pressurised hydraulic fluid between supply lines (not shown) at the goaf side of the conveyor 10 and the hydraulic appliances of the two roof support units A and B. The intermediate member 24'' is pivotally connected to the conveyor 10.

We claim:

1. A mineral mining installation comprising a conveyor, a plurality of hydraulically-operated roof support units positioned side-by-side at one side of the conveyor, hydraulic supply lines running along said one side of the conveyor, and a plurality of elongate, flat, plate-like intermediate members positioned at said one side of the conveyor, the intermediate members each being provided with a plurality of longitudinally-extending internal bores for feeding hydraulic fluid from the supply lines to the roof support units, wherein each internal bore is provided with a port at each end thereof, one of said ports being hydraulically connected to one of said hydraulic lines by a flexible hose, the other of said ports being hydraulically connected to one of said roof support units by another flexible hydraulic hose, and wherein the ports are sockets projecting from the upper surfaces of the intermediate members.

2. An installation according to claim 1, wherein each intermediate member extends between a respective pair of adjacent roof support units, each internal bore is provided with a first port at that end adjacent to the conveyor and with two second ports at that end thereof which is remote from the conveyor, one second port of each internal bore serving to feed hydraulic fluid to one of the associated pair of roof support units, and the other second port of each internal bore serving to feed hydraulic fluid to the other of the associated pair of roof support units.

3. An installation according to claim 1, wherein the internal bores of each intermediate member converge from that end of the intermediate member adjacent to said one side of the conveyor.

4. An installation according to claim 1, wherein the intermediate members are positioned adjacent to the base of the conveyor.

5. An installation according to claim 1, wherein the sockets at the two ends of a given internal bore are mutually outwardly inclined.

6. An installation according to claim 1, wherein each roof support unit is provided with a respective intermediate member.

7. An installation according to claim 6, wherein each roof support unit is provided with an advance mechanism including a hydraulic advance ram and relay rod means for transferring force from the advance ram to the conveyor, the intermediate member associated with a given roof support unit being positioned between its relay rod means and the conveyor.

8. An installation according to claim 7, wherein the relay rod means of each roof support unit is rigidly attached to the associated intermediate member, and each of the intermediate members is pivotally attached to the conveyor.

9. An installation according to claim 8, wherein the relay rod means of each roof support unit is rigidly attached to a head which forms part of the associated intermediate member.

10. An installation according to claim 9, wherein each head projects upwardly beyond the upper surface of its intermediate member, and is provided with wings extending towards the conveyor at the lateral edges of that intermediate member, the sockets of that intermediate member adjacent to the associated roof support unit being positioned between said wings.

11. An installation according to claim 8, wherein each intermediate member is pivotally attached to the conveyor by means of a respective bifurcated hinge member, the sockets of that intermediate member adjacent to the conveyor being positioned in the region of the bifurcated hinge member.

12. A roof support unit for a mineral mining installation, the roof support unit having a roof shield supported on a floor sill by hydraulic props, and an intermediate member associated with the floor sill, the intermediate member being provided with a plurality of longitudinally-extending internal bores for feeding hydraulic fluid to the roof support unit, wherein each internal bore is provided with a port at each end thereof, one of said ports being hydraulically connected to a hydraulic supply line by a flexible hose, the other of said ports being hydraulically connected to the roof support unit by another flexible hydraulic hose, and wherein the ports are sockets projecting from the upper surface of the intermediate member.

13. A roof support unit according to claim 12, further including an advance mechanism having a hydraulic advance ram mounted on the floor sill and relay rod means acted upon by the advance ram, one end of the relay rod means being slidably mounted on the floor sill, the other end of the relay rod means being attached to the intermediate member.

* * * * *